US008157355B2

(12) United States Patent
Akahane

(10) Patent No.: US 8,157,355 B2
(45) Date of Patent: Apr. 17, 2012

(54) HEATING CHANNEL UNIT, LIQUID EJECTING HEAD, AND LIQUID EJECTING APPARATUS

(75) Inventor: Fujio Akahane, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 867 days.

(21) Appl. No.: 12/209,554

(22) Filed: Sep. 12, 2008

(65) Prior Publication Data

US 2009/0073234 A1 Mar. 19, 2009

(30) Foreign Application Priority Data

Sep. 13, 2007 (JP) ..... 2007-237486
Jul. 25, 2008 (JP) ..... 2008-192199

(51) Int. Cl.
*B41J 2/05* (2006.01)

(52) U.S. Cl. ..... 347/56

(58) Field of Classification Search ..... 347/56, 347/60, 50, 54, 57–59, 40, 42, 44, 46, 12, 347/13, 19, 5, 9
See application file for complete search history.

(56) References Cited

FOREIGN PATENT DOCUMENTS

| | | |
|---|---|---|
| EP | 1 238 809 A1 | 9/2002 |
| EP | 1 688 260 A2 | 8/2006 |
| JP | 04-247944 | 9/1992 |
| JP | 05-193155 | 8/1993 |
| JP | 09-141892 | 6/1997 |
| JP | 10-157097 | 6/1998 |
| JP | 2003-011349 | 1/2003 |
| JP | 2007-090785 | 4/2007 |
| WO | 95/16569 | 6/1995 |

*Primary Examiner* — Kristal Feggins
(74) *Attorney, Agent, or Firm* — Workman Nydegger

(57) ABSTRACT

A heating channel unit which includes a communicating channel for supplying liquid from a liquid supply source to a liquid ejecting head. The heating channel unit is detachably mounted between the liquid supply source and the liquid ejecting head, and includes a heat generator which heats the liquid in the communicating channel.

10 Claims, 10 Drawing Sheets

HEATING CHANNEL UNIT, LIQUID EJECTING HEAD, AND LIQUID EJECTING APPARATUS

CROSS-REFERENCES AND RELATED APPLICATIONS

The entire disclosures of Japanese Patent Application No. 2007-237486, filed Sep. 13, 2007, and Japanese Patent Application No. 2208-192199, filed Jul. 25, 2008, is expressly incorporated herein by reference.

BACKGROUND OF THE INVENTION

1. Technical Field

The present invention relates to a liquid ejecting apparatus. More specifically, the present invention relates to a heating channel unit mounted to a liquid ejecting head for heating liquid flowing in a liquid channel of a head.

2. Related Art

One type of liquid ejecting head used in a liquid ejecting apparatus currently known in the art comprises an ink jet recording head (hereinafter, referred to as a recording head) which is mounted in an ink jet printer. The recording head is capable of ejecting a liquid ink onto a recording or target medium, such as a piece of paper or other type of recording sheet, during a recording or printing process. In addition to being used in ink jet printers, liquid ejecting heads are also used for ejecting various functional liquids such as a coloring material used in a color filter of liquid crystal displays, organic material used in an organic electroluminescence (EL) displays, and electrode material used for forming an electrodes.

Recently, a light curing ink has been used to print images. The light curing ink is cured by irradiating energy in the ink using a light such as an ultraviolet ray. The light curing ink is cured by irradiating light onto a recording medium having a poor ink absorbency in order to record an image. One difficulty in using the light curing ink, however, is that the light curing ink has a viscosity higher than general ink. Thus, in order to eject the light curing ink from the liquid ejecting head, the viscosity must be reduced.

The curing sensitivity of the light curing ink also depends on the temperature of the ink. More specifically, the light curing sensitivity is decreased at low temperatures and increased at high temperatures. In order to increase the light curing sensitivity, a liquid ejecting head for heating the light curing ink using a heating unit has been developed, such as in, for example, Japanese Patent Applications JP-A-09-141892 and JP-A-2003-011349.

One difficulty with these configurations, however, is that the heating unit is added to the outer surface of the liquid ejecting head, where the ink flowing in the head channel is heated by the heat of the heating unit. In this case, in order to heat the ink from room temperature to a temperature (for example, 40° C.) suitable for the ejection, the heating unit must heath the outer surface of the liquid ejecting to a higher temperature, increasing the amount of power consumed by the recording head, and consequently, shortening the life span of the recording head.

BRIEF SUMMARY OF THE INVENTION

An advantage of some aspects of the invention is that it provides a heating channel unit capable of efficiently heating liquid flowing in a channel of a liquid ejecting head, which improves the properties of a standard liquid ejecting head and liquid ejecting apparatus.

One aspect of the invention is a heating channel unit capable of being detachably mounted between a liquid supply source and a liquid ejecting head. The heating channel unit comprises a communicating channel capable of transferring liquid from the liquid supply source to the liquid ejecting head and a heat generator which is capable of heating the liquid in the communicating channel.

A second aspect of the invention is a liquid ejecting head capable of receiving liquid from a liquid supply source and ejecting the liquid. The liquid ejecting head comprises a detachable heating channel unit including a communicating channel which allows liquid to be transferred from the liquid supply source to a head channel and a heat generator which heats the liquid in the communicating channel.

A third aspect of the invention is a liquid ejecting apparatus comprising a liquid ejecting head capable of receiving liquid from a liquid supply source and ejecting the liquid, a heating channel unit including a communicating channel which allows the liquid to flow from the liquid supply source to the liquid ejecting head and a heat generator capable of heating the liquid in the communicating channel, and a power source capable of supplying power to the heat generator, wherein heating channel unit is detachably mounted between the liquid supply source and the liquid ejecting head.

Using the configurations described herein, it is possible to efficiently heat the liquid, while saving power and space. Since the liquid can be efficiently heated, it is possible to suppress the heating temperature of the heating channel unit and, as a result, suppress adverse influence of the heat on the liquid ejecting head. Since the heating channel unit can be detachably mounted in an existing liquid ejecting head that does not currently have the ability to heat the liquid, the general applicability of the invention is high.

BRIEF DESCRIPTION OF THE DRAWINGS

The invention will be described with reference to the accompanying drawings, wherein like numbers reference like elements. In the drawings.

DESCRIPTION OF EXEMPLARY EMBODIMENTS

Hereinafter, embodiments of the invention will be described with reference to the accompanying drawings. In the following embodiments, various embodiments of the invention are described, but the invention is not limited to the embodiments, and the described embodiments are not intended to limit the scope of the invention.

In the present embodiment, an ink jet recording head, herein referred to as a recording head, is described as an example of a liquid ejecting head. The ink jet recording head is mounted in an ink jet printer, referred to as a printer, which is an example of a liquid ejecting apparatus capable performing embodiments of the invention.

Figure 1:
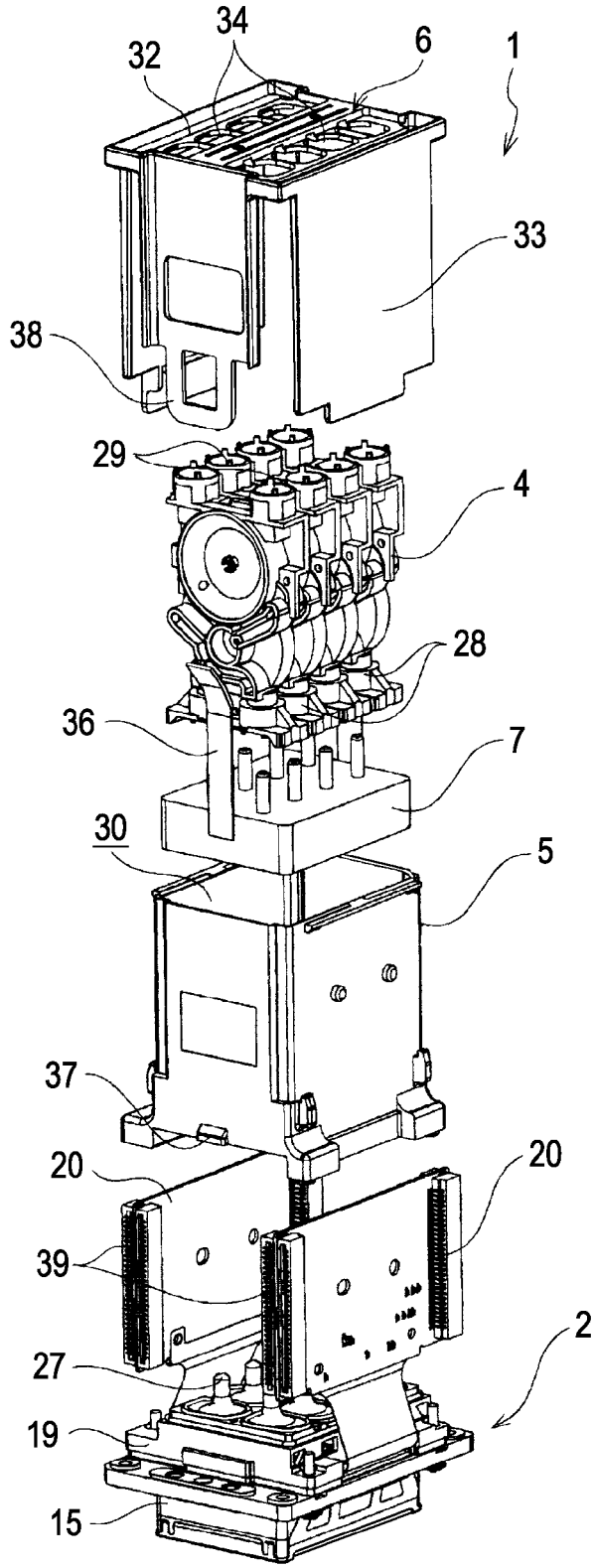
FIG. 1 is an exploded perspective view showing the configuration of a recording head.
Figure 2:
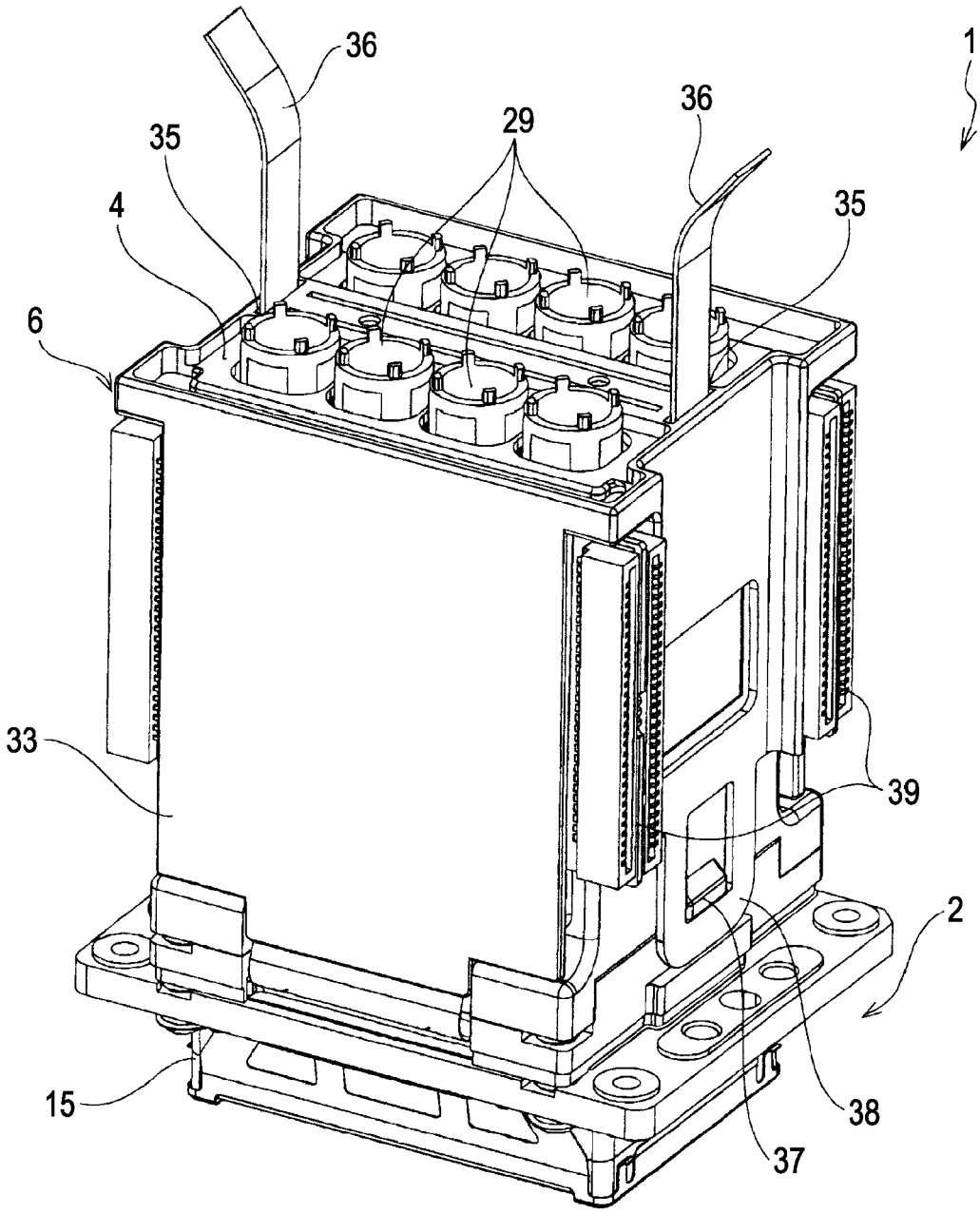
FIG. 2 is a perspective view showing the recording head.
Figure 3:
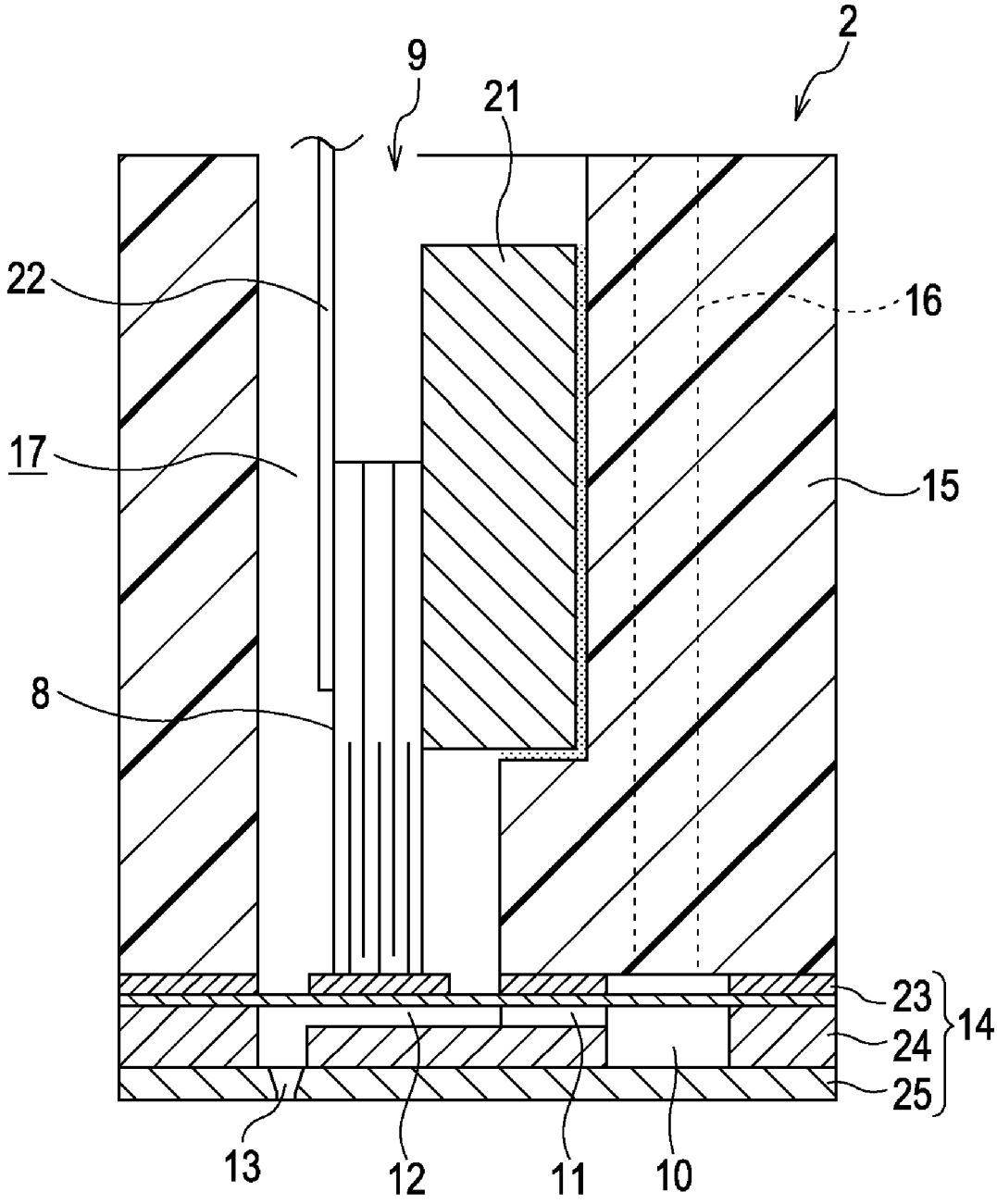
FIG. 3 is a cross-sectional view showing main portions of the recording head.

FIGS. 1 and 2 are views showing the configuration of a recording head 1, wherein FIG. 1 is an exploded perspective view of the recording head 1 and FIG. 2 is a perspective view of the recording head 1. FIG. 3 is a cross-sectional view showing main portions of a head unit 2.

The recording head 1 includes the head unit 2, magnetic sealing valves 4, which comprise a liquid supply source, an inner case 5, an outer case 6 and a heating channel unit 7.

As shown in FIG. 3, the head unit 2 includes an actuator unit 9 including a plurality of piezoelectric vibrators 8, a channel unit 14, and a head case 15. The channel unit 14 forms a series of ink channels where ink from a common ink chamber 10 may be transported to nozzle openings 13 via an ink supply port 11 and a pressure generation chamber 12.

The head case 15 is a hollow box type casing and includes a case channel 16 which is a channel for introducing ink from the magnetic sealing valves 4 to the common ink chamber 10 and a containing chamber 17 for containing the actuator unit 9. The head case 15 is formed of epoxy resin which is a kind of thermosetting resin. The channel unit 14 is fixed to a channel attachment surface of the head case 15. An introduction needle unit 19 (see FIG. 1) is mounted on the upper surface of the head case 15, which is opposite to the channel attachment surface.

The actuator unit 9 includes the piezoelectric vibrators 8 which act as a pressure generation unit, a metal fixing plate 21 to which the piezoelectric vibrators 8 are adhered, and a flexible cable 22 for applying a driving signal from driving substrates 20 to the piezoelectric vibrators 8. The metal fixing plate 21 is formed of a metal such as stainless steel. Each of the piezoelectric vibrators 8 are mounted on the fixing plate 21 in a cantilever manner so that a free end protrudes outward from the front end surface of the fixing plate 21. In addition to this configuration, an electrostatic actuator, a magnetostrictive element, and a heating element may be used as the pressure generation unit instead of the piezoelectric vibrators.

The channel unit 14 is manufactured by adhering and integrating channel unit configuration members composed of a vibration plate 23, a channel substrate 24, and a nozzle substrate 25 in a lamination process. The pressure generation chamber 12 of the channel unit 14 comprises an elongated chamber, which extends in a direction that is perpendicular to the nozzle array direction of the nozzle openings 13. The common ink chamber 10 is a chamber where the ink is introduced from the magnetic sealing valves 4 and subsequently distributed and supplied to the pressure generation chamber 12 via the ink supply port 11.

The nozzle substrate 25 placed on the bottom of the channel unit 14 is a thin metal plate in which a plurality of nozzle openings 13 are formed in a line with a pitch corresponding to a dot forming density. The nozzle substrate 25 of the present embodiment is made of a stainless steel plate and has a plurality of arrays of the nozzle openings 13, which comprise nozzle arrays or groups which are parallel to the scanning direction of the recording head 1. One nozzle array is comprised of, for example, 360 nozzle openings 13.

The introduction needle unit 19 is placed on the upper surface of the head case 15. The introduction needle unit 19 is formed of synthetic resin and includes a plurality of ink introduction needles 27 which are formed in the upper surface thereof with a filter disposed in-between. A heating channel unit 7 is detachably mounted on the upper surface of the introduction needle unit 19, which comprises a mounting portion. When the heating channel unit 7 is mounted on the introduction needle unit 19, the ink introduction needles 27 are inserted into the heating channel unit 7. When the heating channel unit 7 is mounted on the upper surface of the introduction needle unit 19, a switch 70 (see FIG. 8) for switching on the power to heat generators 46 of the heating channel unit 7 is provided, as described more fully below.

Focusing channels (not shown) corresponding to the ink introduction needles 27 are formed in the introduction needle unit 19. The focusing channels communicate with a case channel 16 of the head case 15 and supply the ink introduced from the ink introduction needle 27 to the pressure chamber via the case channel 16. A series of channels from the ink introduction needles 27 to the nozzle openings 13 via the case channel 16, the common ink chamber 10 and the pressure generation chamber 12 comprise the head channels of the invention and the present invention includes eight sets of head channels in the recording head 1.

The magnetic sealing valves 4 each have an ink supply tube (not shown) from the printer main body connected to channel connection portions 29 formed on the upper surface thereof. The magnetic sealing valves 4 receive the ink from the ink supply tube, adjust the supply pressure of the ink, and introduce the ink into the pressure generation chamber. In the present embodiment, a total of four magnetic sealing valves 4 are disposed in the inner case 5. In one magnetic sealing value 4, two channels are formed, which correspond to two inks. An insertion portion 28 is provided on each of the magnetic sealing valves 4 and the connection portion 43 (see FIGS. 4 to 7) of the heating channel unit 7 is inserted into the insertion portion 28. In a configuration where the heating channel unit 7 is not used, the ink introduction needles 27 of the introduction needle unit 19 are inserted into the insertion portion 28.

The magnetic sealing valves 4 open and close valves using a variation in internal pressure and have a magnetic sealing function for controlling the supply of the ink to the head unit 2. That is, in a non-recording state, where the recording head 1 is not ejecting any ink, the magnetic sealing valves 4 close the valves such that the ink is not supplied to the recording head 1. In contrast, if the recording head 1 is ejecting ink in a recording operation (ejecting operation), and is consuming ink, the pressures of pressure adjustment chambers in the magnetic sealing valves 4 are reduced, and the magnetic sealing valves 4 open the valves such that the ink is supplied to the recording head 1.

The inner case 5 is a sleeve-shaped member with opened upper and lower surfaces, and is mounted on the upper surface of the head unit 2 so as to enclose the ink introduction needles 27. The planar shape of the opening of the inner case 5 is approximately rectangular and the internal space thereof is a storage space 30 for storing the heating channel unit 7 and the magnetic sealing valves 4. The driving substrates 20 are mounted on an outer side surface of the inner case 5.

The outer case 6 is a rectangular member having a base surface 32 for covering the upper opening of the inner case 5 and a sidewall 33 extending downward from the both edges of the base surface 32 in direction perpendicular to the array direction of the magnetic sealing valves, toward the head unit 2. The sidewall 33 function as substrate covering walls for covering the driving substrates 20 fixed to the side surface of the inner case 5. In the base surface 32, openings 34 are formed for exposing the channel connection portions 29 of the magnetic sealing valves 4 stored in the storage space 30. Slits 35 are formed in the both edges of the base surface 32 in the valve array direction. As shown in FIG. 2, lead lines 36 of the heating channel unit 7 received in the inner case 5 protrude towards the outside of the head via the slits 35. The lead lines 36 are electrically connected to a power source of the printer main body. The power is fed to the heat generators 46 via the lead lines 36.

An engaged portion 38 which is engaged with an engaging claw 37 of the inner case 5 is formed on the base surface 32 of the outer case 6. The front end of the engaged portion 38 has an approximately U-shape. When the outer case 6 is attached to the inner case 5, the engaging claw 37 of the inner case 5 is engaged to a through-hole of the engaged portion 38 and the outer case 6 is fixed to the inner case 5.

The inner case 5 is attached to the head unit 2 in so as to enclose the ink introduction needles 27 of the introduction needle unit 19 at all four sides, with the heating channel unit 7 and the magnetic sealing valves 4 being sequentially stored in the storage space 30 of the inner case 5, and the driving substrates 20 being fixed to the side surface of the inner case 5. When the channel connection portions 29 of the magnetic sealing valves 4 are exposed from the openings 34 and the lead lines 36 are led out from the slits 35, the outer case 6 is attached to the outside of the inner case 5 and the driving substrates 20 on the side surface of the inner case 5 or the upper opening of the storage space 30 are covered by the outer case 6. In this state, the connectors 39 of the driving substrates 20 are exposed and the connectors 39 are connected to the cable of the printer main body.

Next, the heating channel unit 7 will be described.

Figure 4:
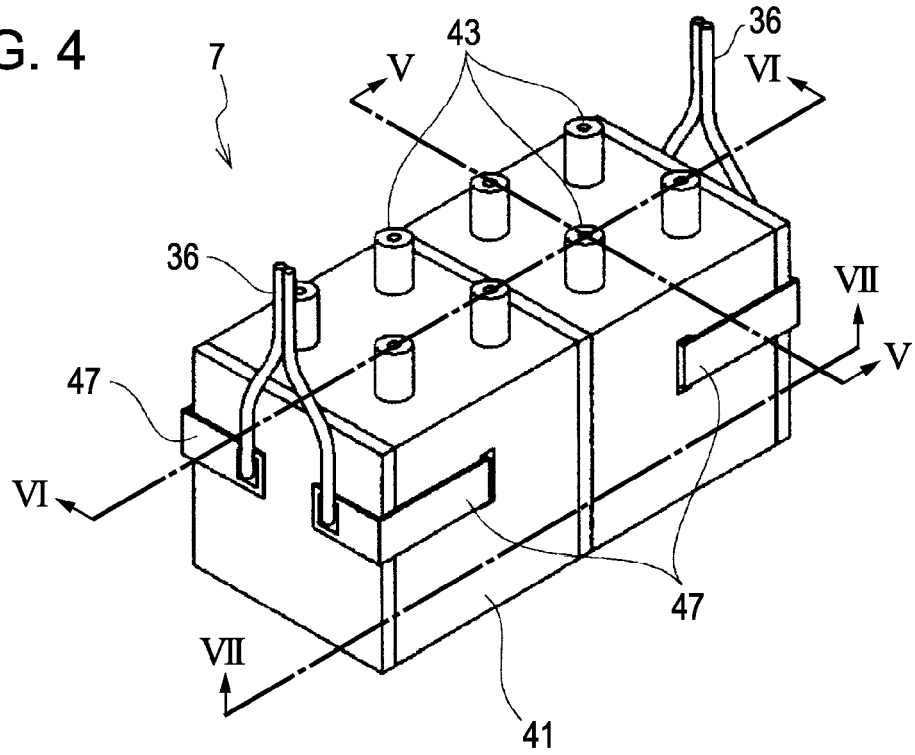
FIG. 4 is a perspective view of a heating channel unit.
Figure 5:
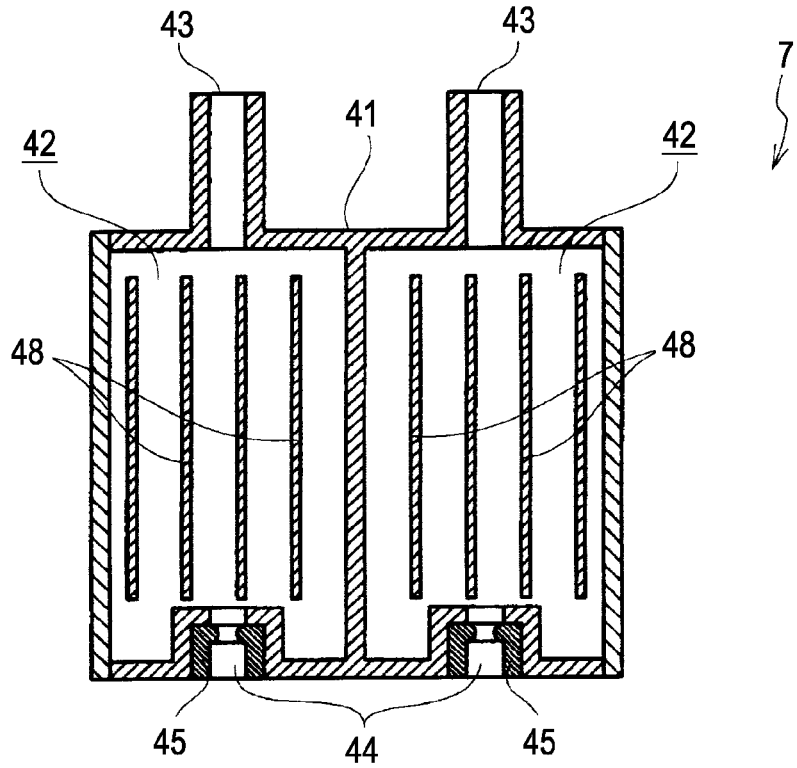
FIG. 5 is a cross-sectional view taken along line V-V of FIG. 4.
Figure 6:
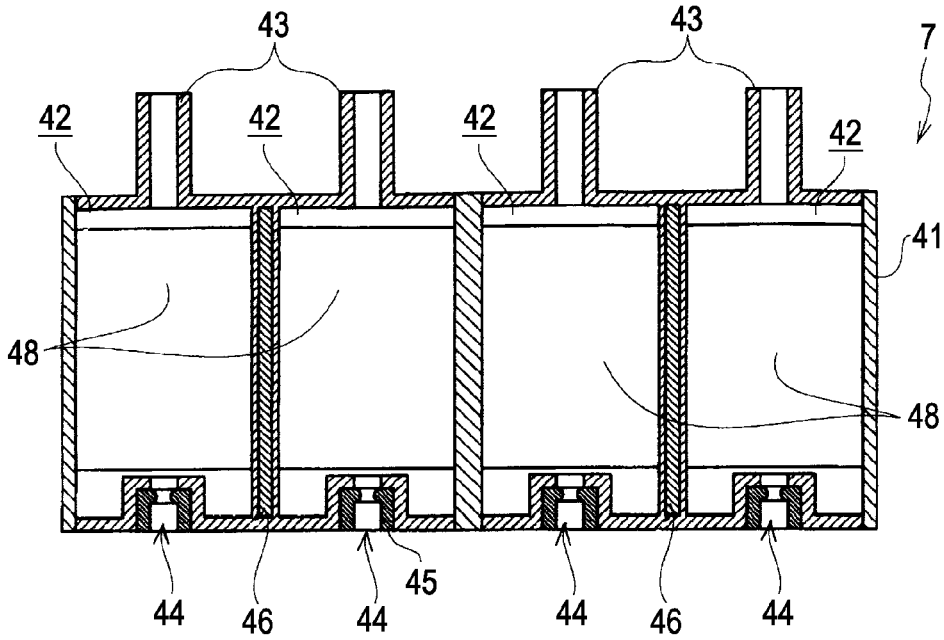
FIG. 6 is a cross-sectional view taken along line VI-VI of FIG. 4.
Figure 7:
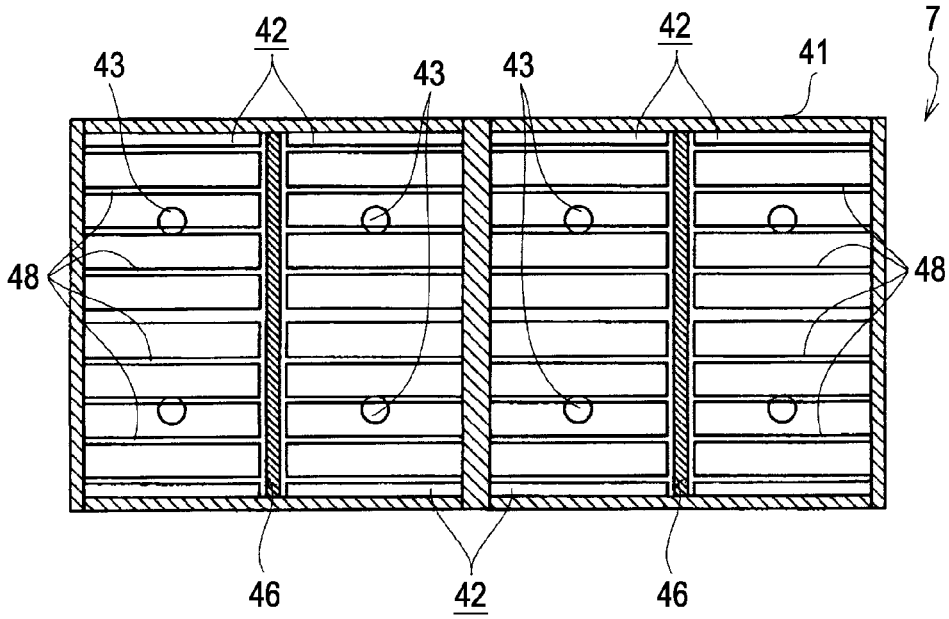
FIG. 7 is a cross-sectional view taken along line VII-VII of FIG. 4.

FIGS. 4 to 7 are views showing an embodiment of the heating channel unit 7, wherein FIG. 4 is a perspective view of the heating channel unit 7, FIG. 5 is a cross-sectional view taken along line V-V of FIG. 4, FIG. 6 is a cross-sectional view taken along line VI-VI of FIG. 4, and FIG. 7 is a cross-sectional view taken along line VII-VII of FIG. 4.

The heating channel unit 7 of the present embodiment is a hollow box type member in which liquid pass portions 42 are partitioned in a base body (casing) 41, which correspond to the channels of the magnetic sealing valves 4. The base body 41 is preferably made of a material having high thermal conductivity (for example, a material having thermal conductivity of 50 W/mk or more) and is formed of metal such as copper or aluminum in the present embodiment. The liquid pass spaces 42 are spaces which function as a portion of a communication channel for communicating with the channels of the magnetic sealing valves 4 and the case channel 16 of the head unit 2. The liquid pass spaces 42 have an inner dimension which is sufficiently larger than the inner diameter of the case channel 16. In the present embodiment, a total of eight liquid pass spaces 42 are partitioned in the base body 41 in correspondence with the channels of the magnetic sealing valves 4 and the case channels 16.

Cylindrical connection portions 43, which communicate with the liquid pass spaces 42, protrude from the upper surface of the base body 41. That is, in the present embodiment, a total of eight connection portions 43 are provided on the upper surface of the base body 41 in correspondence with the liquid pass spaces 42. The connection portions 43 are inserted into the insertion portion 28 when the magnetic sealing valves 4 are mounted and ink is introduced from the magnetic sealing valves 4 into the liquid pass spaces 42. On the lower surface of the base body 41, a total of eight needle insertion portions 44 are formed to correspond with the ink introduction needles 27. The needle insertion portions 44 are formed by recessing portions of the lower surface of the base body 41 toward the liquid pass spaces 42 so as to form concave portions which communicate with the liquid pass spaces 42 and provide packing portions 45 in the concave portions. As shown in FIG. 8, when the heating channel unit 7 is mounted on the upper surface of the head unit 2, or more specifically, the upper surface of the introduction needle unit 19, the ink introduction needles 27 are inserted into the liquid pass spaces 42 via the needle insertion portions 44 and the ink in the liquid pass spaces 42 is introduced from the ink introduction needles 27 into the head channels.

As shown in FIGS. 6 and 7, the heat generators 46 are embedded in the base body 41 by insert molding. The heat generators 46 are, for example, sheathed heat generators. The base body 41 of the present embodiment has a total of two heat generators 46, which are embedded in walls between the four liquid pass spaces 42. Positive and negative electrode terminals 47 are provided on the outer surface of the base body and are connected to the heat generators 46, while the lead lines 36 are electrically connected to the electrode terminals 47. As described above, the other ends of the lead lines 36 are electrically connected to the power source of the printer main body. The heating channel unit 7 is connected to the heat generators 46 via the lead lines 36 and the electrode terminals 47, causing the heat generators 46 to generate heat which heats the ink in the liquid pass spaces 42. That is, the heating channel unit 7 comprises a channel member having a heating function.

In the present embodiment, a plurality of partition walls 48 are protrusions which extend from the walls where the heat generators 46 are embedded toward the opposite surface. The horizontal width (extension lengths) of the partition walls 48) is equal to that of the liquid pass spaces 42 and the height of the partition walls 48 is smaller than that of the liquid pass spaces 42 (see FIG. 6). Each of the liquid pass spaces 42 is vertically partitioned into a plurality of portions by the partition walls 48, which communicate with each other at the upper and lower ends. That is, the plurality of partition walls 48 form protrusions which form the liquid pass spaces 42 in the communication channel. That is, the communication channel is divided into a plurality of channels by a plurality of parallel partition walls 48. It is preferable that the partition walls 48 are integrally molded with the base body 41. By providing the plurality of partition walls 48 in the liquid pass spaces 42, it is possible to increase a contact area with the ink in the liquid pass spaces 42. Thus, the heat from the heat generators 46 is more efficiently delivered to the ink.

Figure 8A:
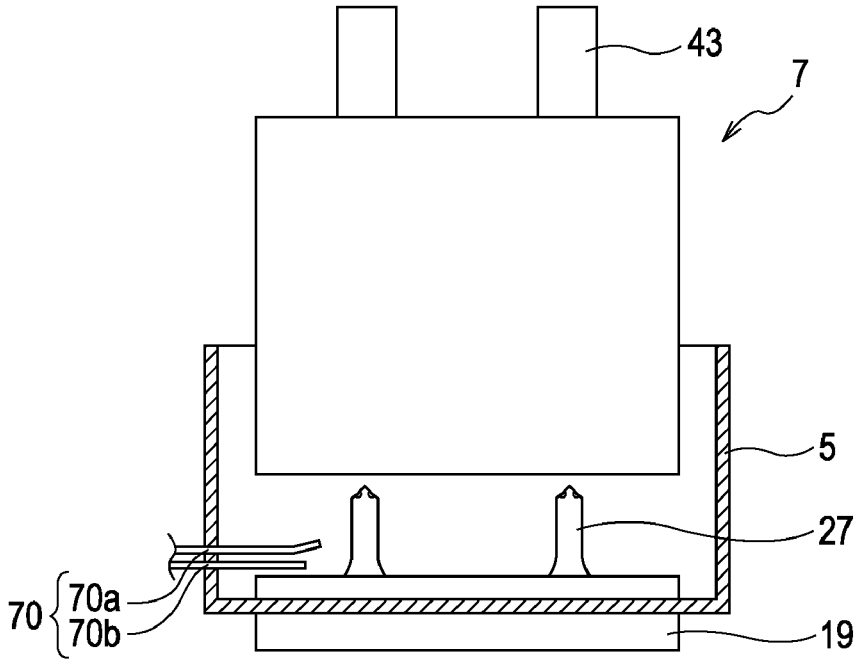
FIGS. 8A and 8B are schematic views showing the configuration of a switch.
Figure 8B:
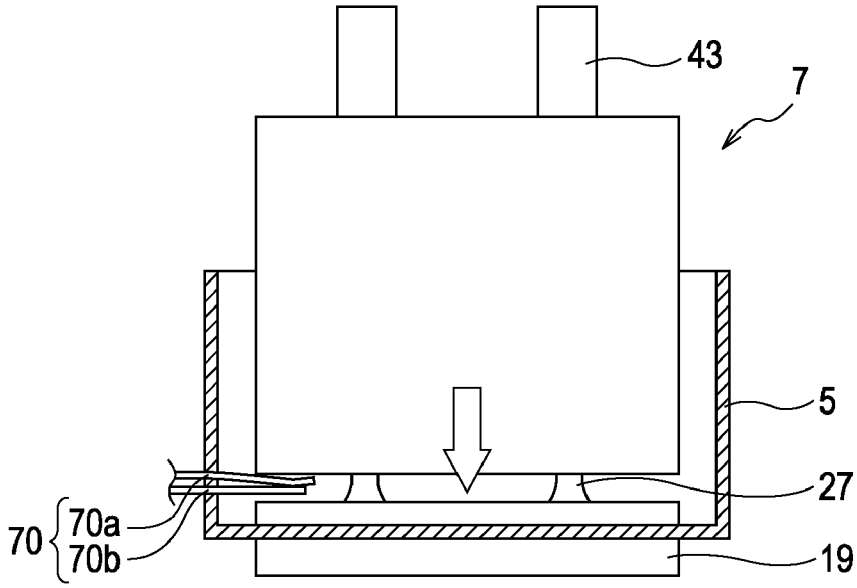

As shown in FIGS. 8A and 8B, a switch 70 for switching the power to the heat generators 46 of the heating channel unit 7 on and off is provided in the head unit 2. The switch 70 includes an upper contact chip 70*a* and a lower contact chip 70*b* which form a pair. The switching of the on state/off state is recognized by a controller of the printer main body. The contact chips 70*a* and 70*b* are composed of metal leaf springs and are placed in the mounting portion of the upper surface of the head unit 2, with a very small gap between them. The front end of the upper contact chip 70*a* of the present embodiment is bent upward and is brought into contact with the bottom of the heating channel unit 7 when the heating channel unit 7 is mounted on the mounting portion of the head unit 2.

As shown in FIG. 8A, the contact chips 70*a* and 70*b* are separated from each other when the heating channel unit 7 is not mounted on the mounting portion of the head unit. That is, the switch 70 is turned off. In the off state, the power is not fed to the heat generators 46 of the heating channel unit 7. In contrast, as shown in FIG. 8B, when the heating channel unit 7 is mounted on the upper surface of the introduction needle unit 19, the upper contact chip 70*a* is pressed downward by the heating channel unit 7 such that the upper contact chip 70*a* is bend downward by elasticity. Accordingly, the upper contact chip 70*a* is brought into contact with and is electrically connected to the lower contact chip 70*b*. That is, the switch 70 is turned on and the power is fed to the heat generators 46. The switching from the off state to the on state of the switch 70 is recognized by the controller of the printer main body and thus the power is fed from the power source of the printer main body to the heat generators 46 via the lead lines 36. Accordingly, the heat generators 46 generate heat so as to heat the ink in the liquid pass spaces 42. That is, the switch 70 is switched to an on state such that the heating of the heat generators 46 of the heating channel unit 7 is allowed. Although the switch 70 is switched to the on state, the power may not be fed to the heat generators 46. In this case, for example, a start timing of the feed of the power from the printer main body to the heat generators 46 is controlled.

Here, the state in which the heating channel unit 7 is mounted on the upper surface of the introduction needle unit 19 indicates a state in which the ink introduction needles 27 are inserted into the liquid pass spaces 42 via the needle insertion portions 44 and the ink in the liquid pass spaces 42 is introduced from the ink introduction needles 27 into the head channels without any leakage.

The switch 70 may be provided in the heating channel unit 7 or the printer main body. At this time, the switch 70 may be provided at any number of positions, so long as the switch is switched to the off state when the heating channel unit 7 is not mounted on the mounting portion of the recording head, and is switched to the on state when the heating channel unit 7 is mounted on the mounting portion of the recording head when the power is being fed to the heat generators 46. The same is true in the following modified examples.

Figure 9A:
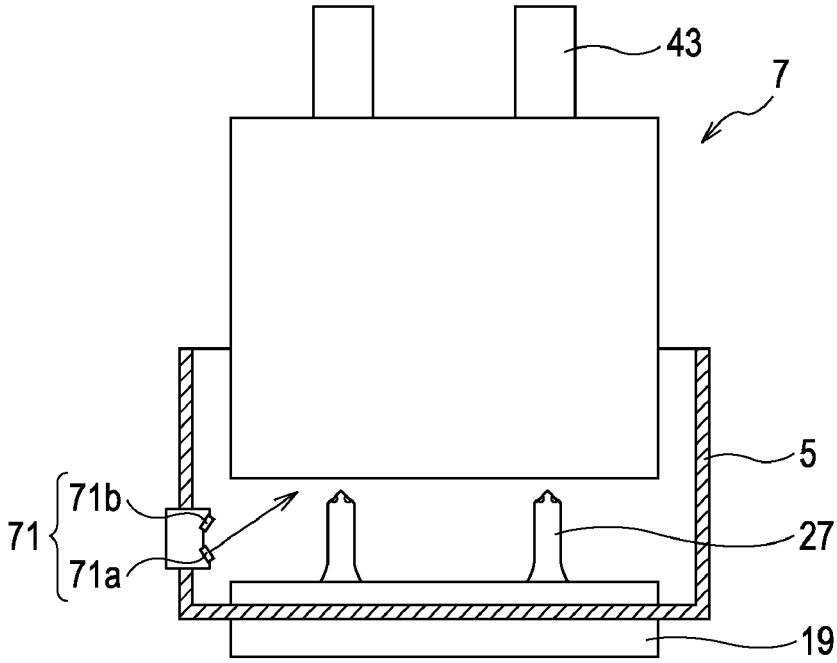
FIGS. 9A and 9B are schematic views showing a first variation of the switch.
Figure 9B:
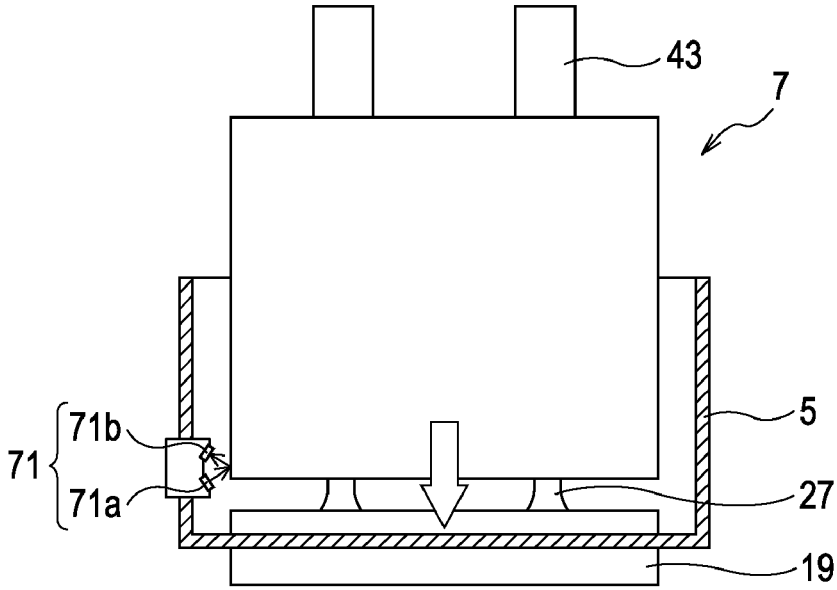

FIGS. 9A and 9B are schematic views showing a first modified example of the switch.

This modified example is different from the above-described configuration in that a switch 71 comprises a photo interrupter or reflective interrupter including a light-emitting element 71*a*, a reflector (not shown) provided on the side of the heating channel unit 7, and a light-receiving element 71*b*. The light-emitting element 71*a* includes, for example, a light-emitting diode which irradiates light to a region in which the heating channel unit 7 is placed. The light-emitting element 71*a* does not irradiate the light to the side surface of the heating channel unit 7 when the heating channel unit 7 is not mounted on the mounting portion of the head unit 2 as shown in FIG. 9A. The light-emitting element 71*b* irradiates the light to the reflector, such as a mirror provided on the side surface of the heating channel unit 7, when the heating channel unit 7 is mounted on the head unit 2 as shown in FIG. 9B, with the optical axis being adjusted such that the light is reflected from the reflector to the light-receiving element 71*b*. The light-receiving element 71*b* includes, for example, a photo transistor, which is capable of receiving the light irradiated from the light-emitting element 71*a* and reflected from the reflector on the side of the heating channel unit 7 and outputting a detection signal to the controller of the printer main body.

When the light from the light-receiving element 71*a* is not being received by the light-receiving element 71*b*, the heating channel unit 7 is in the off state, and power is not applied to the heat generators 46 of the heating channel unit 7. In contrast, when the light from the light-emitting element 71*a* is reflected from the reflector on the side of the heating channel unit 7 and is received by the light-receiving element 71*b*, the heating channel unit 7 is an on state, as shown in FIG. 9B. When the switch 71 is switched from the off state to the on state, the detection signal is output from the light-receiving element 71*b* to the controller of the printer main body and thus the power is fed to the heat generators 46. Thus, the heating of the heat generators 46 is allowed.

In the switch 71, a transmissive photo interrupter configuration may be used in which the light-emitting element 71*a* and the light-receiving element 71*b* face each other in the region where the heating channel unit 7 is placed.

Figure 10A:
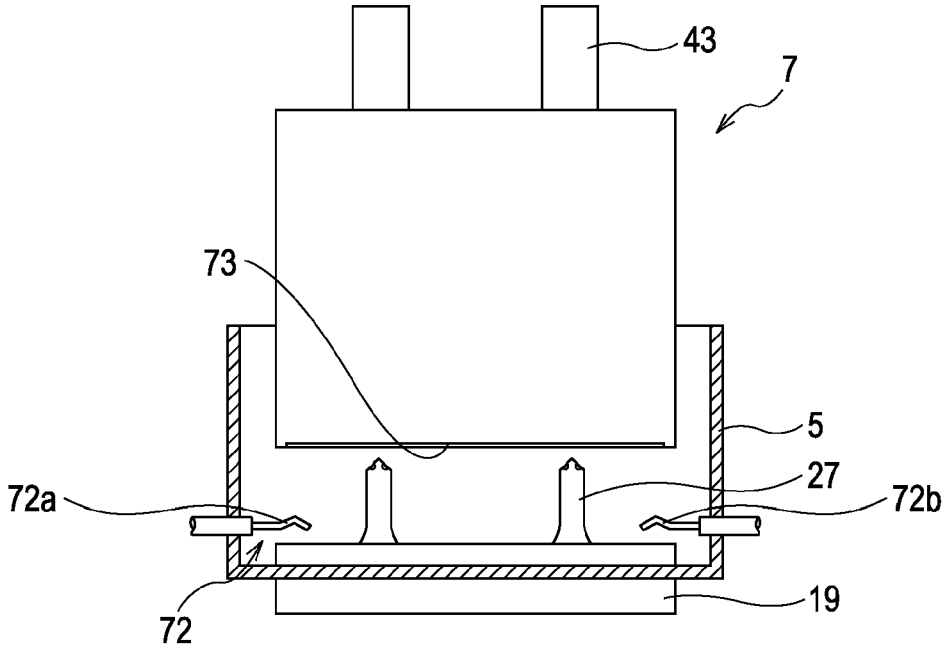
FIGS. 10A and 10B are schematic views showing a second variation of the switch.
Figure 10B:
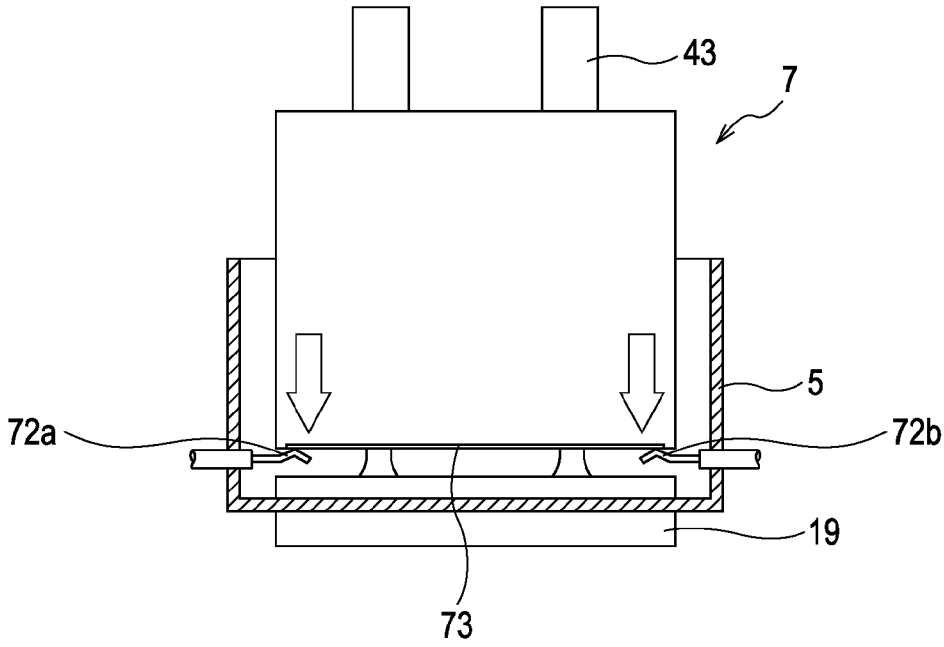

FIGS. 10A and 10B are schematic views showing a second modified example of the switch.

In this modified example, the switch 72 comprises one contact terminal 72*a* and another contact terminal 72*b* which face each other across the region where the heating channel unit 7 is placed. A conductive portion 73 made of a metal plate is provided on the bottom of the heating channel unit 7. As shown in FIG. 10A, since the conductive portion 73 of the heating channel unit 7 and the both contact terminals 72*a* and 72*b* of the switch 72 are separated from each other when the heating channel unit 7 is not mounted on the head unit 2, one contact terminal 72*a* is not electronically connected to the other contact terminal 72*b*. That is, the switch 72 is in an off state. In contrast, as shown in FIG. 10B, when the heating channel unit 7 is mounted on the head unit 2, the conductive portion 73 of the heating channel unit 7 is brought into contact with one contact terminal 72*a* and the other contact terminal 72*b*. Accordingly, one contact terminal 72*a* and the other contact terminal 72*b* are electrically connected to each other via the conductive portion 73 and the switch 72 is switched to the on state. When the switch 72 is switched to the on state, the heating of the heating generators 46 of the heating channel unit 7 is allowed.

If the base body 41 of the heating channel unit 7 is formed of a member having conductivity, the conductive portion 73 is unnecessary.

Figure 11A:
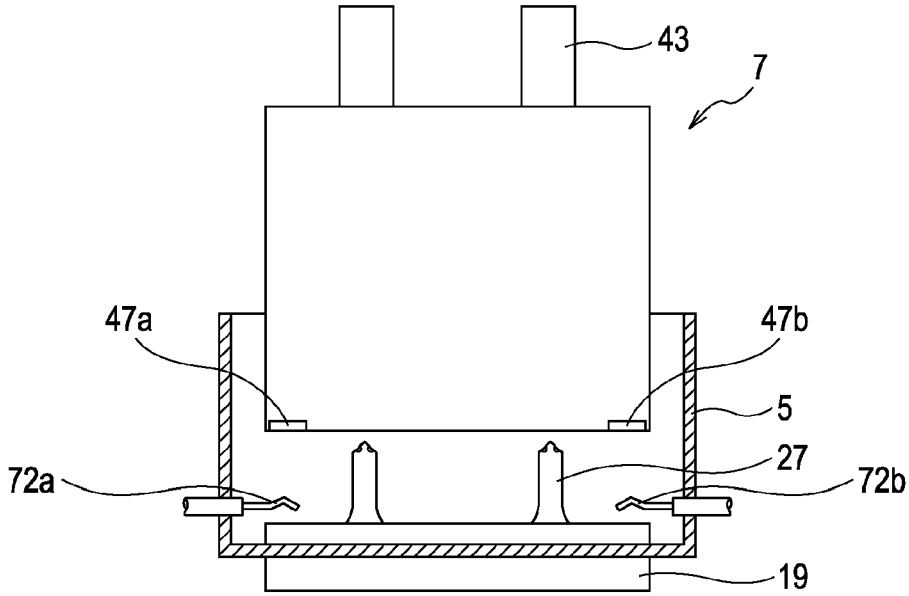
FIGS. 11A and 11B are schematic views showing a third variation of the switch.
Figure 11B:
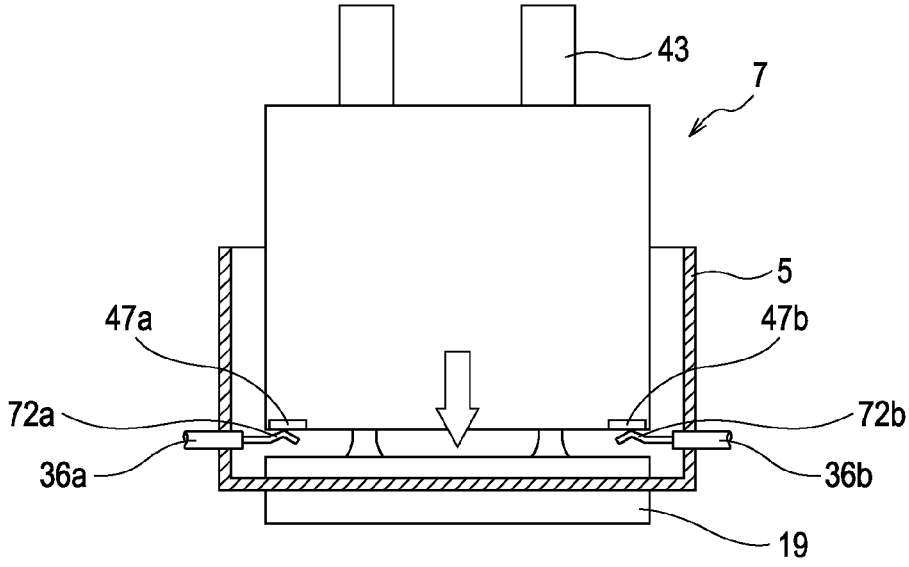

FIGS. 11A and 11B are schematic views showing a third modified example.

In this modified example, electrode terminals 47*a* and 47*b* which are electrically connected to the heat generators 46 are provided on the bottom of the heating channel unit 7 and contact terminals 72*a* and 72*b* are arranged on the head unit 2 in locations that correspond with the electrode terminals 47*a* and 47*b*. The contact terminals 72*a* and 72*b* are provided on the distal ends of the lead lines 36*a* and 36*b*, respectively. The switch of the invention is constituted by the electrode terminals 47*a* and 47*b* and the contact terminals 72*a* and 72*b*. As shown in FIG. 11A, when the heating channel unit 7 is not mounted on the head unit 2, the contact terminals 72*a* and 72*b* and the electrode terminals 47*a* and 47*b* are separated and the heating channel unit is in the off state. In contrast, as shown in FIG. 11B, when the heating channel unit 7 is mounted on the mounting portion of the head unit 2, the positive electrode terminal 47*a* of the heating channel unit 7 is electrically connected to one contact terminal 72*a* and the negative electrode terminal 47*b* is electrically connected to the other contact terminal 72*b*. Accordingly, the head unit side switches 72 and the heating channel unit side switches 47 are switched to the on state and the power is directly fed to the heating generators 46 via the contact terminals 72*a* and 72*b* and the electrode terminals 47*a* and 47*b*. By this configuration, the power to the heating generators 46 can be switched by a simpler mechanism.

As described above, since the recording head 1 of the invention includes the detachable heating channel unit 7, it is possible to eject ink having high viscosity (in more detail, 10 mPa·s or more at 25° C.) such as a light curing ink while minimizing design variation. That is, since the ink introduced from the magnetic sealing valves 4 is ejected from the nozzle openings 13 after the viscosity of the ink is decreased by heating the ink by the heating channel unit 7, it is possible to obtain the same ejection characteristics, such as the ejection amount, the ejection speed or the like, as regular ink. The invention is applicable to a variety of inks having high viscosity, such as an aqueous ink and a solvent ink, in addition to the light curing ink.

Since the heating channel unit 7 of the invention heats the ink, the ink can be efficiently heated and power and space can be saved. Since the heating channel unit can be detachably mounted in the existing recording head, general-purpose application of the invention is high. Since the liquid can be efficiently heated to a temperature (for example, 40° C.) suitable for the ejection, the heat generation temperature of the heating channel unit 7 can be suppressed. As a result, the adverse influence on the liquid ejecting head can be suppressed.

If the heating channel unit has a light-shielding property and the ink is of the light curing type, it is possible to suppress the ink from being cured in the channel unit.

When the heating channel unit 7 is mounted on the mounting portion of the recording head 1, the switches 70, 71 and 72 are switched from the off state to the on state and the heating of the heat generators 46 is allowed. Accordingly, it is possible to prevent the heat generators 46 from being heated when the heating channel unit 7 is not present. Since the presence of the heating channel unit 7 can be detected by the switch, it is possible to prevent the recording head 1 from operating when the heating channel unit 7 is not present.

However, the invention is not limited to the above-described embodiments and can be variously modified on the basis of claims.

Although the heat generators 46 are embedded in the base body 41 in the above-described embodiment, the invention is not limited to this configuration. For example, the heat generators 46 may be provided in the liquid pass spaces 42. That is, the ink may be directly heated by the heat generators 46.

Although, in the above-described embodiment, the plurality of partition walls 48 extend from the walls in which the heat generators 46 are embedded to the opposite walls and the liquid pass spaces 42 are divided into the plurality of liquid pass spaces communicating with each other by the partition walls 48, the invention is not limited to this. For example, a plurality of protrusions having needle-like shapes and fin-like shapes may be formed on the inner wall surfaces of the liquid pass spaces 42. As may be understood by one of ordinary skill in the art, a structure in which a larger contact area with the ink in the liquid pass spaces 42 is ensured is preferable.

Figure 12:
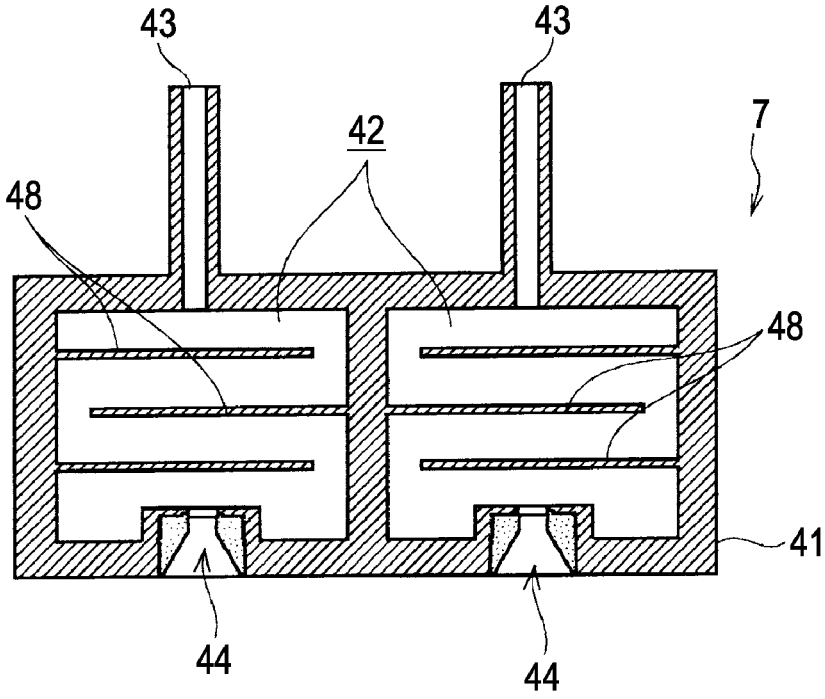
FIG. 12 is a longitudinal cross-sectional view of a heating channel unit according to a second embodiment of the invention.
Figure 13:
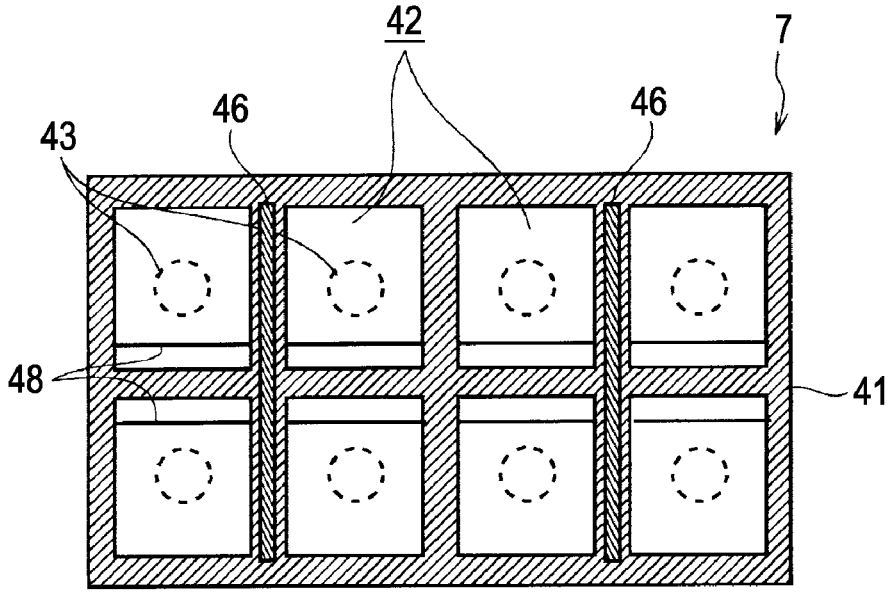
FIG. 13 is a transverse cross-sectional view of the heating channel unit according to the second embodiment of the invention.

FIGS. 12 and 13 are views showing a second embodiment of the heating channel unit 7, wherein FIG. 12 is a longitudinal cross-sectional view of the heating channel unit 7 and FIG. 13 is a traverse cross-sectional view of the heating channel unit 7.

The present embodiment is different from the first embodiment in the direction that the partition walls 48 protrude. More specifically, a plurality of partition walls 48 horizontally extend from a vertical wall of the base body 41 in parallel, from a ceiling surface of the base body 41. Because of the shape of the partition walls 48, the direction of ink flow from the heating channel unit 7 is changed from the vertical direction of the heating channel unit 7 to the horizontal direction.

As shown in FIG. 12, the extension length of the partition walls 48 of the present embodiment is shorter than the horizontal width of the liquid pass spaces 42. The plurality of partition walls 48 are alternately arranged on the vertical walls of the base body 41. Each of the liquid pass spaces 42 is divided into the plurality of portions in a direction that is different from the flow direction of the ink by the partition walls 48 such that a plurality of communicating spaces (small spaces) communicating with each other are partitioned and the communicating channel is formed in a zigzag manner.

According to the configuration of the present embodiment, since each of the liquid pass spaces 42 is divided into the plurality of portions in the direction different from the flow direction of the ink by the partition walls 48, the flow of the ink is suppressed by the partition walls 48. In addition, since the channel is formed in the zigzag manner, the distance that the ink must travel from the introduction of the ink into the heating channel unit 7 to the outflow can be increased and thus the ink can be efficiently heated. Since the ink can be slowly heated, the need to quickly heat the ink can be reduced.

During a cleaning process, where ink is forcedly removed from the nozzle openings 13 of the recording head 1 of the first embodiment, the inks are susceptible to mixing at the connection portion 43 and the outlet needle connection portion 44 of the heating channel unit 7. In the present embodiment, however, this problem can be suppressed.

Although, in the present embodiment, the recording head has an off-carriage configuration in which the ink of the printer main body is received by the magnetic sealing valve 4 and is introduced into the head channel is described, the invention is applicable to an on-carriage type configuration as well. That is, configurations in which an ink cartridge (liquid storage member) for storing the ink is disposed in the storage space 30 in place of the magnetic sealing valve 4 (liquid introduction member) may be also be used.

The invention is not limited to the recording head 1 and is also applicable to a liquid ejecting head mounted in a display manufacturing apparatus, an electrode manufacturing apparatus, a tip manufacturing apparatus, and a micro pipette, or other liquid ejecting head where the liquid needs to be heated.

What is claimed is:

1. A heating channel unit capable of being detachably mounted between a liquid supply source and a liquid ejecting head, the heating channel unit comprising:

a communicating channel capable of transferring liquid from the liquid supply source to the liquid ejecting head; and a heat generator which is capable of heating the liquid in the communicating channel;

wherein a plurality of protrusions are provided in the heating channel unit in order to form liquid pass spaces in the communicating channel, and wherein the protrusions comprise partition walls which extend from an inner wall surface of the heating channel unit with the heat generator embedded therein, the liquid pass space being divided by the partition walls.

2. The heating channel unit according to claim 1, further comprising a switch capable of allowing the heat generator to heat the liquid in the communicating channel when the heating channel unit is mounted in a mounting portion of the liquid ejecting head.

3. The heating channel unit according to claim 2, wherein the switch comprises a contact terminal electrically connected to the heat generator, such that when the heating channel unit is mounted in the mounting portion, the contact terminal is electrically connected to a contact provided in the mounting portion, causing power to be transferred to the heat generator via the contact terminal.

4. The heating channel unit according to claim 1, wherein the liquid pass space is partitioned in a direction which is different from the direction that the liquid in the communicating channel flows.

5. A liquid ejecting head capable of receiving liquid from a liquid supply source and ejecting the liquid, the liquid ejecting head comprising:

a detachable heating channel unit including a communicating channel which allows liquid to be transferred from the liquid supply source to a head channel and a heat generator which heats the liquid in the communicating channel;

wherein a plurality of protrusions are provided in the heating channel unit in order to form liquid pass spaces in the communicating channel, and wherein the protrusions comprise partition walls which extend from an inner wall surface of the heating channel unit with the heat generator embedded therein, the liquid pass space being divided by the partition walls.

6. The liquid ejecting head according to claim 5, further comprising a switch capable of allowing the heat generator to heat the liquid in the communicating channel when the heating channel unit is mounted in a mounting portion of the liquid ejecting head.

7. The liquid ejecting head according to claim 6, wherein the switch comprises a contact terminal electrically connected to the heat generator, such that when the heating channel unit is mounted in the mounting portion, the contact terminal is electrically connected to a contact provided in the mounting portion, causing power to be transferred to the heat generator via the contact terminal.

8. A liquid ejecting apparatus comprising:

a liquid ejecting head capable of receiving liquid from a liquid supply source and ejecting the liquid;

a heating channel unit including a communicating channel which allows the liquid to flow from the liquid supply source to the liquid ejecting head and a heat generator capable of heating the liquid in the communicating channel; and a power source capable of supplying power to the heat generator, wherein heating channel unit is detachably mounted between the liquid supply source and the liquid ejecting head, wherein a plurality of protrusions are provided in the heating channel unit in order to form liquid pass spaces in the communicating channel, and wherein the protrusions comprise partition walls which extend from an inner wall surface of the heating channel unit with the heat generator embedded therein, the liquid pass space being divided by the partition walls.

9. The liquid ejecting apparatus according to claim 8, further comprising a switch capable of allowing the heat generator to heat the liquid in the communicating channel when the heating channel unit is mounted between the liquid supply source and the liquid ejecting head.

10. The liquid ejecting apparatus according to claim 9, wherein the power supply supplies power to the heat generator when the switch allows the heat generator to heat the liquid in the communicating channel.

* * * * *